US008344827B2

(12) United States Patent
Kim et al.

(10) Patent No.: US 8,344,827 B2
(45) Date of Patent: Jan. 1, 2013

(54) PHASE SHIFTER WHERE A ROTATION MEMBER IS COMBINED WITH A GUIDE MEMBER

(75) Inventors: Ji-Hoon Kim, Seoul (KR); Byung-Il Oh, Gyeonggi-do (KR); Hyung-Joon Noh, Gyeonggi-Do (KR)

(73) Assignee: Ace Antenna Corp., Incheon (KR)

( * ) Notice: Subject to any disclaimer, the term of this patent is extended or adjusted under 35 U.S.C. 154(b) by 206 days.

(21) Appl. No.: 12/681,606

(22) PCT Filed: Oct. 19, 2007

(86) PCT No.: PCT/KR2007/005136

§ 371 (c)(1),
(2), (4) Date: Apr. 2, 2010

(87) PCT Pub. No.: WO2009/044951

PCT Pub. Date: Apr. 9, 2009

(65) Prior Publication Data

US 2010/0219907 A1 Sep. 2, 2010

(30) Foreign Application Priority Data

Oct. 5, 2007 (KR) ..... 10-2007-0100539

(51) Int. Cl.
*H01P 1/18* (2006.01)

(52) U.S. Cl. ..... 333/156; 333/161

(58) Field of Classification Search ..... 333/161, 333/156, 139; 342/372, 375
See application file for complete search history.

(56) References Cited

U.S. PATENT DOCUMENTS

| | | | | |
|---|---|---|---|---|
| 5,798,675 | A | 8/1998 | Drach | |
| 7,233,217 | B2 | 6/2007 | Phillips et al. | |
| 2006/0077098 | A1* | 4/2006 | Zimmerman | 342/372 |
| 2006/0164185 | A1* | 7/2006 | Tae et al. | 333/161 |

FOREIGN PATENT DOCUMENTS

KR 2005-0008882 A 1/2005

* cited by examiner

*Primary Examiner* — Benny Lee
(74) *Attorney, Agent, or Firm* — Edwards Wildman Palmer LLP

(57) ABSTRACT

A phase shifter for reducing a loss by friction, etc by combining a rotation member with a guide member is disclosed. The phase shifter includes a rotation member, a first rotation axis member combined with the rotation member in a direction crossing over the rotation member, a first guide member combined with the first rotation axis member, and configured to rotate in accordance with rotation of the first rotation axis member, and a first power delivering member configured to connect at least one of the rotation member and the first rotation axis member to the first guide member.

16 Claims, 6 Drawing Sheets

PRIOR ART Fig. 1
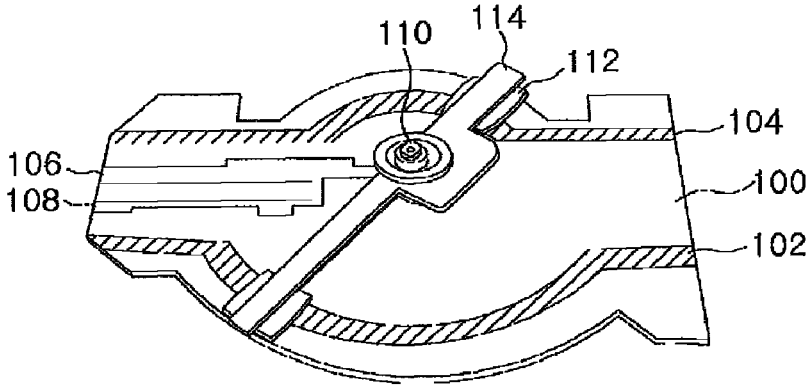
PRIOR ART Fig. 2
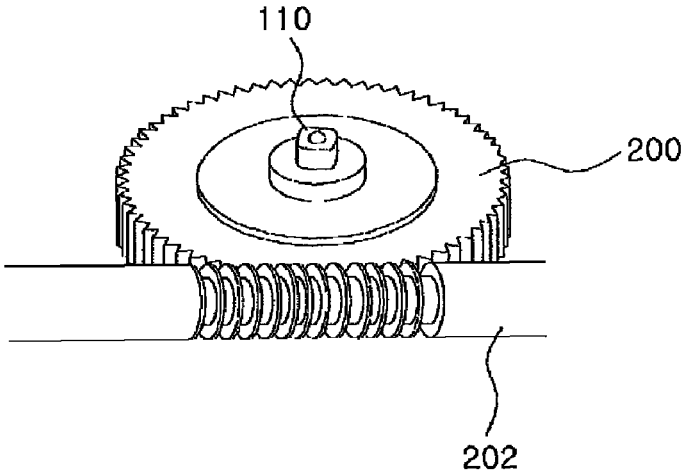
PRIOR ART Fig. 3
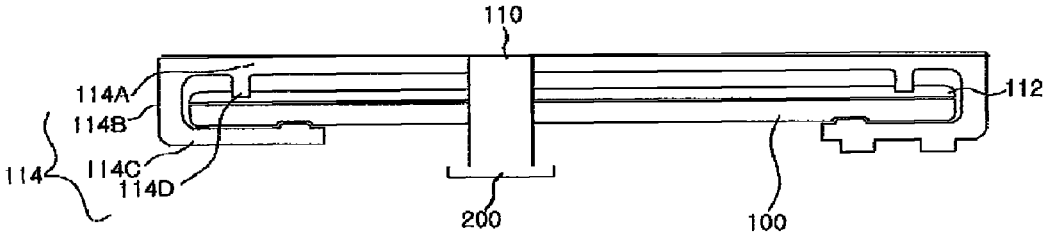

(A) (B)

PHASE SHIFTER WHERE A ROTATION MEMBER IS COMBINED WITH A GUIDE MEMBER

CROSS-REFERENCES TO RELATED APPLICATIONS

This application is a U.S. national phase application, pursuant to 35 U.S.C. §371 of PCT/KR2007/005136, filed Oct. 19, 2007, designating the United States, which claims priority to Korean Application No. 10-2007-0100539, filed Oct. 5, 2007. The entire contents of the aforementioned patent applications are incorporated herein by this reference.

TECHNICAL FIELD

Example embodiment of the present invention relates to a phase shifter, more particularly relates to a phase shifter for reducing a loss by friction, etc by combining a rotation member with a guide member.

BACKGROUND ART

A phase shifter is connected to an antenna device, e.g. radiation device, and changes a phase of a signal transmitted to the antenna device. In addition, the phase shifter has a structure as shown in below FIG. 1.

FIG. 1 is a top view illustrating a common phase shifter. FIG. 2 is a view illustrating schematically a lower part of the phase shifter in FIG. 1.

In FIG. 1, the phase shifter includes a dielectric substrate 100, a first line 102, a second line 104, an input line 106, an output line 108, a rotation axis member 110, an arm member 112 and a guide member 114.

The dielectric substrate 100 is made up of dielectric material having certain dielectric constant. Here, a ground plate (not shown) is formed on a lower surface of the dielectric substrate 100.

The first line 102 is formed on the dielectric substrate 100 as a conductor. Here, ends of the first line 102 are connected to a first radiation device and a second radiation device.

The second line 104 is formed on the dielectric substrate 100 as a conductor, wherein ends of the second line 104 are connected to a third radiation device and a fourth radiation device.

The input line 106 receives a RF signal as a conductor.

The received RF signal is outputted to a fifth radiation device through a first dielectric substrate area located below the output line 108 of the dielectric substrate 100, or is coupled at the rotation axis member 110 and then is transmitted through a second dielectric substrate area located below the aim member 112 of the dielectric substrate 100. Here, a third line (not shown) as a conductor is formed on a lower surface of the arm member 112. Subsequently, the RF signal transmitted through the second dielectric substrate area is coupled between end of the third line and the lines 102 and 104, and then is transmitted to corresponding radiation devices.

The output line 108 as a conductor outputs the RF signal to the first radiation device without changing phase of the RF signal considering beam characteristic of an array antenna having the radiation devices.

The rotation axis member 110 is combined with a gear wheel 200 as shown in FIG. 2, and is connected to the arm member 112 and the guide member 114 as shown in FIG. 1. Here, the gear wheel 200 rotates in response to rotation of the gear worm 202, and so a rotary power in accordance with the rotating is provided to the arm member 112 through the guide member 114. That is, the phase shifter rotates the gear worm 202 in a forward direction or a reverse direction for the purpose of changing the phase of the signals transmitted to the radiation devices, thereby rotating the arm member 112.

Hereinafter, combination relation of elements in the phase shifter will be described in detail.

FIG. 3 is a sectional view illustrating the phase shifter in FIG. 1.

In FIG. 3, the rotation axis member 110 is combined with the gear wheel 200, and is connected to the arm member 112 and the guide member 114 through the dielectric substrate 100.

The guide member 114 is connected to the rotation axis member 110, rotates in response to rotation of the rotation axis member 110, and includes a guide base member 114A, a side member 114B, a supporting member 114C and a projection member 114D.

The guide base member 114A is located on an upper surface of the atm member 112.

The supporting member 114C is longitudinal-extended in a direction of the rotation axis member 110 from the side member 114B, is located on a lower surface of the dielectric substrate 100, and is supported by the dielectric substrate 100.

The projection member 114D is projected from the guide base member 114A, and is inserted into a part of the arm member 112 as shown in FIG. 3. As a result, the arm member 112 is fixed to the guide member 114, thereby rotated with the guide member 114 when the rotation axis member 110 is rotated.

In brief, the phase shifter rotates the guide member 114 as much as desired length by rotating the gear worm 202 and the gear wheel 200 so as to control phase change of the signals. As a result, the arm member 112 connected to the guide member 114 is rotated with desired phase change.

However, in case that the gear worm 202 is rotated in a forward direction and then rotated in a reverse direction in the phase shifter, loss of the rotary power from the gear worm 202 and the gear wheel 200 may occur until the rotary power is provided to the arm member 112 due to friction between the gear worm 202 and the gear wheel 200 and loss in a process of delivering the power, etc.

SUMMARY OF THE INVENTION

Technical Problem

Accordingly, the present invention is provided to substantially obviate one or more problems due to limitations and disadvantages of the related art.

An exemplary embodiment of the present invention provides a phase shifter combining a rotation member with a guide member through a power delivery member so that loss of a power delivered to an arm member is reduced.

Technical Solution

A phase shifter according to one exemplary embodiment of the present invention includes a rotation member; a first rotation axis member combined with the rotation member in a direction crossing over the rotation member; a first guide member combined with the first rotation axis member, and configured to rotate in accordance with rotation of the first rotation axis member; and a first power delivering member configured to connect at least one of the rotation member and the first rotation axis member to the first guide member.

The phase shifter further includes a first arm member longitudinal-extended in an outside direction of the first rotation axis from the first rotation axis member, and connected to the first guide member; and a first line disposed on the first arm member.

The phase shifter further includes a first dielectric substrate located between the rotation member and the first arm member, wherein the first rotation axis member penetrates the first dielectric substrate, and a second line as a conductor is disposed on the first dielectric substrate. In addition, the first guide member includes a first guide base member disposed in a longitudinal direction of the first arm member; a first supporting member supported by the first dielectric substrate; and a first guide projection member projected in a direction of the first power delivering member from the first supporting member, and configured to combine with the first power delivering member.

The first rotation axis member includes a rotation axis base member configured to penetrate the first dielectric substrate; an upper member formed at one end of the rotation axis base member in an outside direction of the rotation axis base member, configured to have circular shape; and a cross typed projection member formed on a lower surface of the upper member. Here, a cross typed receiving member for receiving the cross typed projection member is formed on one side of the first guide base member.

The phase shifter further includes a second rotation axis member combined with the first rotation axis; a second arm member connected to the second rotation axis member, and longitudinal-extended in an outside direction of the second rotation axis member from the second rotation axis member; and a second guide member connected to the second rotation axis member and the second arm member, and configured to rotate the second arm member in accordance with the rotation of the second rotation axis member. Here, a third line as a conductor is disposed on one side of the second arm member.

The first rotation axis member includes a first rotation axis base member; and a first rotation axis combination member formed at one end of the rotation axis base, and configured to have circular shape, wherein a cross typed first rotation axis projection member and at least one rotation axis inserting member are formed on one side of the first rotation axis combination member. Additionally, the second rotation axis member includes a second rotation axis base member; and a second rotation axis combination member faced to the first rotation axis combination member at an end of the second rotation axis base member, and configured to have circular shape, wherein a first rotation axis receiving member for receiving the first rotation axis projection member and at least one second rotation axis projection member inserted into the rotation axis inserting member are formed on one side of the second rotation axis combination member.

The rotation inserting member is hole.

A cross typed third rotation axis member is formed on the other side of the first rotation axis combination member, and a first guide receiving member for receiving the third rotation axis projection member is formed on an upper surface of the first guide member.

The phase shifter further includes a second dielectric substrate located between the first guide member and the second arm member, wherein the second rotation axis member penetrates the second dielectric substrate, and a fourth line as a conductor is disposed on the second dielectric substrate. Here, the second guide member includes a second guide base member formed in a longitudinal direction of the second arm member; and a second supporting member supported by the second dielectric substrate.

The first guide member further includes a supporting member receiving member formed in a direction of the second guide member from the first guide member at an end of the first guide member so that the second supporting member of the second guide member is received.

A second guide projection member is formed at one side of the first guide member, and a second guide receiving member for receiving the second guide projection member is formed on the second supporting member of the second guide member.

A recess or hole is formed on the first power delivering member, and wherein the first guide member is inserted into the recess or hole.

An inserting section is formed on the first guide member, and the first power delivering member has bent shape. Here, one end of the first power delivering member is combined with one or more of the rotation member and the first rotation axis member, and the other end of the first power delivering member is inserted into the inserting section of the first guide member.

The phase shifter further includes a second power delivering member configured to combine at least one of the rotation member and the first rotation axis member with the first guide member. Here, the first power delivering member is combined with one end of the first guide member, and the second power delivering member is combined with other end of the first guide member.

A phase shifter according to another example embodiment of the present invention includes a rotation member; a rotation axis inserting member disposed in a vertical direction of the rotation member; a rotation axis member combined with the rotation member under the condition that the rotation axis member is inserted into the rotation axis inserting member; an arm member connected to the rotation axis member, and longitudinal-extended in an outside direction of the rotation axis member from the rotation axis member; a guide member combined with the rotation axis member and the arm member, and configured to rotate the arm member in accordance with rotation of the rotation axis; and a power delivering member configured to connect the rotation axis inserting member to the guide member.

An inserting section is formed on a part of the power delivering member. Here, a part of the guide member is inserted into the inserting section.

The power delivering member has bent shape, and an inserting member is formed on the guide member. Here, the power delivering member is inserted into the inserting member.

Advantageous Effects

A phase shifter according to an exemplary embodiment of the present invention combines a guide member with a rotation member through a power delivery member, and loss of a power due to friction, etc is reduced when a driving member is rotated in a forward direction and then is rotated in a reverse direction. As a result, a rotary power in accordance with rotation of the rotation member may be delivered with little loss.

A phase shifter according to another example embodiment of the present invention uses a separable rotation axis member, and so sub-phase shifters may be easily combined and separated. Accordingly, use of the phase shifter is enhanced.

BRIEF DESCRIPTION OF DRAWINGS

Example embodiments of the present invention will become more apparent by describing in detail example embodiments of the present invention with reference to the accompanying drawings, in which:

FIG. 1 is a top view illustrating a common phase shifter;

FIG. 2 is a view illustrating schematically a lower part of the phase shifter in FIG. 1;

FIG. 3 is a sectional view illustrating the phase shifter in FIG. 1;

BEST MODE FOR CARRYING OUT THE INVENTION

Figure 4:
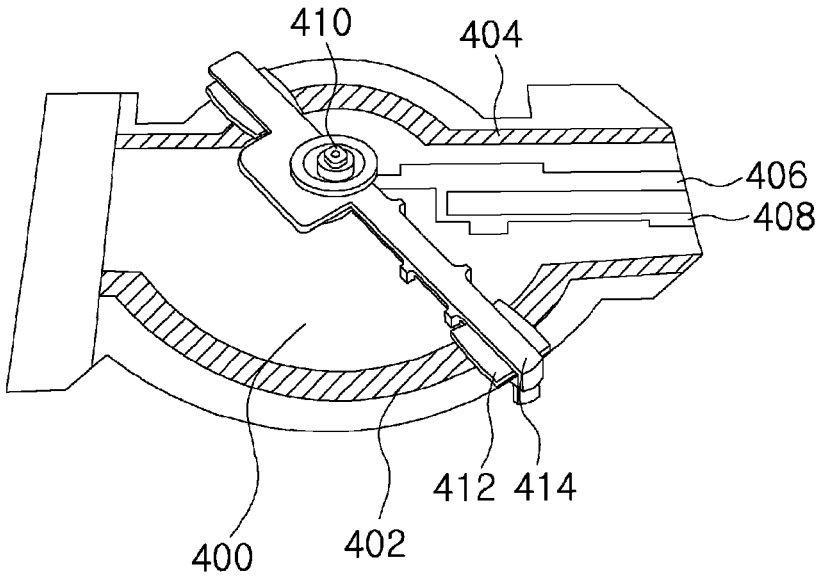
FIG. 4 is a top view illustrating a phase shifter according to a first example embodiment of the present invention.

Example embodiments of the present invention are disclosed herein. However, specific structural and functional details disclosed herein are merely representative for purposes of describing example embodiments of the present invention, however, example embodiments of the present invention may be embodied in many alternate forms and should not be construed as limited to example embodiments of the present invention set forth herein.

Accordingly, while the invention is susceptible to various modifications and alternative forms, specific embodiments thereof are shown by way of example in the drawings and will herein be described in detail. It should be understood, however, that there is no intent to limit the invention to the particular forms disclosed, but on the contrary, the invention is to cover all modifications, equivalents, and alternatives falling within the spirit and scope of the invention. Like numbers refer to like elements throughout the description of the figures.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (i.e., "between" versus "directly between", "adjacent" versus "directly adjacent", etc.).

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 5:
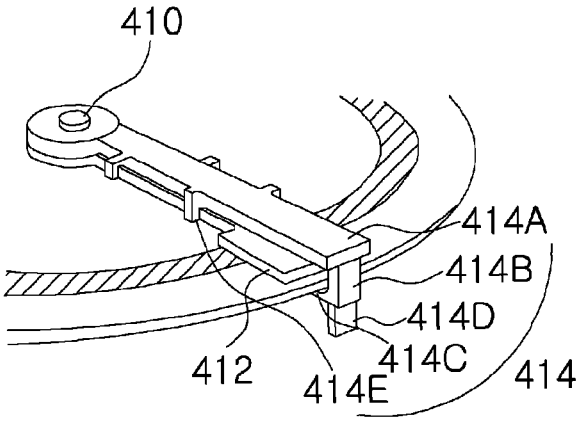
FIG. 5 is a side view illustrating the phase shifter in FIG. 4 according to an exemplary embodiment of the present invention.
Figure 6:
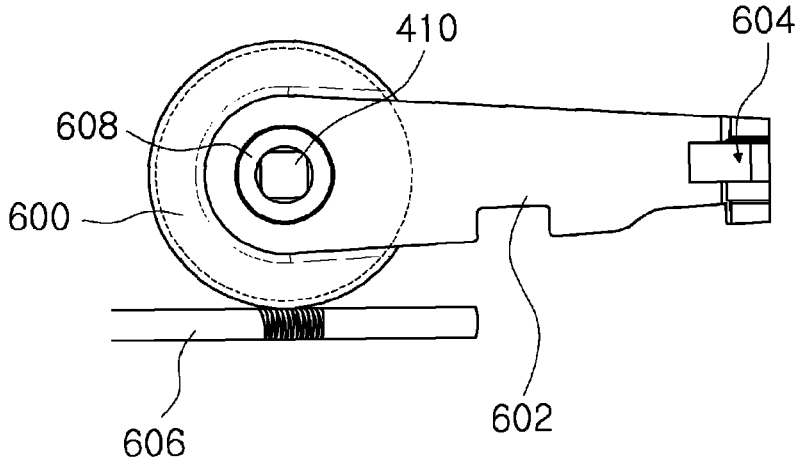
FIG. 6 is a view illustrating schematically a lower part of the phase shifter in FIG. 4 according to an exemplary embodiment of the present invention.
Figure 7:
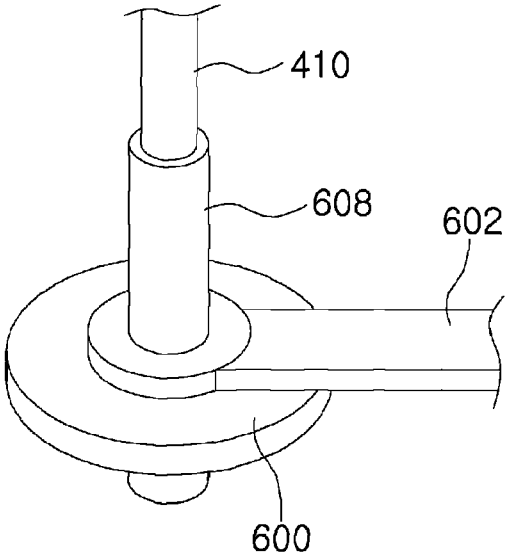
FIG. 7 is a perspective view illustrating schematically the lower part of the phase shifter in FIG. 6.
Figure 8:
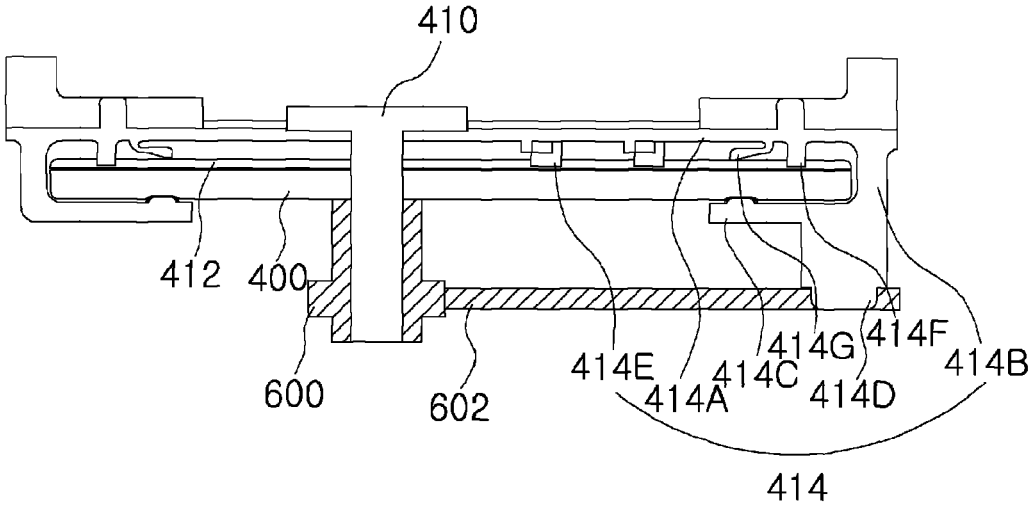
FIG. 8 is a sectional view illustrating the phase shifter in FIG. 4 according to an exemplary embodiment of the present invention.

FIG. 4 is a top view illustrating a phase shifter according to a first example embodiment of the present invention, and FIG. 5 is a side view illustrating the phase shifter in FIG. 4 according to an exemplary embodiment of the present invention. FIG. 6 is a view illustrating schematically a lower part of the phase shifter in FIG. 4 according to an exemplary embodiment of the present invention, and FIG. 7 is a perspective view illustrating schematically the lower part of the phase shifter in FIG. 6. FIG. 8 is a sectional view illustrating the phase shifter in FIG. 4 according to an exemplary embodiment of the present invention.

In FIG. 4, the phase shifter of the present embodiment is coupled to radiation devices (not shown), and changes phase of signals transmitted to the radiation devices. In addition, the phase shifter includes a dielectric substrate 400, a first line 402, a second line 404, an input line 406, an output line 408, a rotation axis member 410, an arm member 412, a guide member 414, a rotation member 600 and a power delivering member 602 (See FIGS. 6 and 7).

The dielectric substrate 400 is made up of dielectric material having certain dielectric constant. Here, a ground plate (not shown) is formed on a lower surface of the dielectric substrate 400. In another example embodiment of the present invention, the ground plate may be formed inside of the dielectric substrate 400.

The first line 402 is a conductor, and is formed with for example curve shape on the dielectric substrate 400. Here, ends of the first line 402 (not shown) are coupled to a part of the radiation devices, e.g. a first radiation device and a second radiation device.

The second line 404 is a conductor, and is formed with for example curve shape on the dielectric substrate 400. Here, ends of the second line 404 are coupled to a part of the radiation devices, e.g. a third radiation device and a fourth radiation device. In an exemplary embodiment of the present invention, an arc of the second line 404 has length smaller than that of the first line 402, and so the second line 404 generates phase change smaller than the first line 402. For example, when a phase of a signal transmitted through a dielectric substrate area located below the first line 402 is changed by 2θ, a phase of a signal transmitted through a dielectric substrate area located below the second line 404 may be changed by θ.

In FIG. 4, the lines 402 and 404 do not have specific pattern. However, the lines 402 and 404 may have specific pattern such as comb pattern, etc so that length of a path through which a corresponding signal is transmitted is increased. As a result, the phase of the signal may be changed in wider range. Here, this pattern is not limited as the comb pattern.

The input line 406 as a conductor receives a RF signal.

The received RF signal is outputted to a corresponding radiation device through a first dielectric substrate area located below the output line 408 of the dielectric substrate 400. In addition, the received RF signal is coupled and divided at the rotation axis member 410, and then the divided signal is transmitted through a second dielectric substrate area located below a third line (not shown) of the dielectric substrate 400, wherein the third line is formed on a lower surface of the arm member 412.

The output line 408 as a conductor outputs the RF signal to a corresponding radiation device as it is without changing a phase of the RF signal considering beam characteristic of an array antenna having the radiation devices.

That is, the RF signal is outputted to a first radiation device of the radiation devices through the output line 408 without change of its phase. Additionally, the RF signal is coupled and divided at the rotation axis member 410, and then the divided signal is transmitted through the second dielectric substrate area located below the third line.

Here, a first divided signal of the divided RF signal is transmitted in a direction of the first line 402, and is coupled between one end of the arm member 412, i.e. one end of the third line and the first line 402. Then, the coupled first divided signal is outputted to a second radiation device and a third radiation device through a dielectric substrate area located below the first line 402. In addition, a second divided signal of the divided RF signal is transmitted in a direction of the second line 404, and is coupled between another end of the arm member 412, i.e. another end of the third line and the second line 404. Then, the coupled second divided signal is outputted to a fourth radiation device and a fifth radiation device through a dielectric substrate area located below the second line 404. As a result, the array antenna having the radiation devices radiates a beam pattern in a given direction, wherein direction of the beam pattern is changed in response to phase change in accordance with operation of the phase shifter.

The rotation axis member 410 is combined with the arm member 412 and the guide member 414, and rotates in accordance with operation of the rotation member 600 as described below. Accordingly, the arm member 412 rotates in a phase change range of the phase shifter, i.e. in an arc range of the lines 402 and 404 in response to the rotation of the rotation axis member 410.

The third line as a conductor is formed on the lower surface of the arm member 412.

The guide member 414 is combined with the rotation axis member 410 and the arm member 412, and delivers a rotary power in accordance with the rotation of the rotation axis member 410 to the arm member 412. As a result, the arm member 412 rotates with the guide member 414 by the delivered power.

The guide member 414 includes a guide base member 414A, a side member 414B, a supporting member 414C, a guide projection member 414D and a side projection member 414E as shown in FIG. 5.

The guide base member 414A is located on an upper surface of the arm member 412, and the side member 414B is disposed at side of the arm member 412.

The supporting member 414C is longitudinal-extended in a direction of the rotation axis member 410 from the side member 414B, and is located on the lower surface of the dielectric substrate 400 so that the supporting member 414C is supported by the dielectric substrate 400. As a result, since the dielectric substrate 400 supports the guide member 414, the guide member 414 may maintain stably the present state.

The side projection member 414E is located at the side of the arm member 412 to fix the arm member 412, and delivers the power applied through the rotation axis member 410 to the arm member 412, thereby rotating the arm member 412.

The guide projection member 414D is longitudinal-extended in a direction of the power delivering member 602 from the supporting member 414C as shown in FIG. 5, and is combined with the power delivering member 602 by being inserted an inserting section 604 of the power delivering member 602 shown in FIG. 6. As a result, the rotatory power generated by the rotation of the rotation member 600 is delivered to the arm member 412 through the rotation axis member 410 and the guide member 414, and is also delivered to the arm member 412 through the power delivering member 602 and the guide member 414. Here, the power delivering member 602 is combined with the rotation member 600, e.g. top surface of a gear wheel as shown in FIG. 7, and has the inserting section 604 into which the guide projection member 414D is inserted.

In an exemplary embodiment of the present invention, the rotation axis member 410 is inserted into a rotation axis member inserting member 608 as shown in FIGS. 6 and 7, wherein the rotation axis member inserting member 608 is extended in a longitudinal direction of the rotation axis member 410. The power delivering member 602 is combined with the rotation axis member inserting member 608 on a top surface of the rotation member 600.

In another example embodiment of the present invention, the power delivering member 602 may be combined with the rotation axis member 410 not the rotation member 600.

The inserting section 604 is for example recess or hole. Here, shape of the inserting section 604 is not limited as long as the guide projection member 414D is combined with the inserting section 604.

The rotation member 600 rotates the rotation axis member 410, and is for example a gear wheel. In this case, the rotation member 600 rotates in response to rotation of a driving member 606, e.g. gear worm as shown in FIG. 6. In other words, in case that a user rotates the gear worm 606 in a specific direction using a motor, etc, the rotation member 600 rotates in response to the rotation of the gear worm 606. Then, the rotation member 600 delivers the rotary power in accordance with the rotation to the guide member 414 and the arm member 412 through the rotation axis member 410 and the power delivering member 602, thereby rotating the guide member 414 and the arm member 412.

In another example embodiment of the present invention, the rotation member 600 and the driving member 606 may be embodied with a helical gear, etc. That is, the rotation member 600 and the driving member 606 are not limited as long as the rotary power is delivered to the rotation axis member 410.

Hereinafter, combination relation of elements in the phase shifter will be described in detail with reference to accompanying drawing FIG. 8.

As shown in FIG. 8, the rotation axis member 410 is connected to the rotation member 600, and is combined with the guide member 414 through the dielectric substrate 400.

The guide member 414 further includes an inserting member 414F for fixing the arm member 412 and a tension member 414G, the side member 414B, the supporting member 414C, the guide projection member 414D and the side projection member 414E.

Since the inserting member 414F fixes the aim member 412 as shown in FIG. 8, more rotary power may be provided through the rotation axis member 410 to the arm member 412.

The supporting member 414C is supported by the dielectric substrate 400, and the guide projection member 414D is extended from the supporting member 414C and is combined with the power delivering member 602.

The tension member 414G assists the arm member 412 and the dielectric substrate 400 so that constant space exists between the arm member 412 and the dielectric substrate 400, thereby embodying desired phase change.

The rotation axis member 410 and the guide member 414 deliver the rotary power of the rotation member 600 to the aim member 412.

Hereinafter, the phase shifter of the present embodiment and the phase shifter in related art will be compared.

The phase shifter in related art rotates a gear wheel by controlling a gear worm, and delivers a rotary power in accordance with rotation of the gear wheel to an arm member through a rotation axis member and a guide member. Here, in case that the gear worm is rotated in a forward direction and then is rotated in a reverse direction in the phase shifter, loss of the rotary power may occur considerably until the rotary power is delivered to the aim member due to friction between the gear worm and the gear wheel and reduction in power delivery inefficiency, etc. Hence, the rotary power is not adequately delivered to the arm member.

However, the phase shifter of the present embodiment delivers the rotary power in accordance with the rotation of the rotation member 600 to the arm member 412 through the rotation axis member 410 and the guide member 414, and delivers also the rotary power to the arm member 412 through the power delivering member 602 and the guide member 414. Here, in case that the rotation member 600 is rotated by using the driving member 606 (FIG. 6), loss of the rotary power delivered to the arm member 412 is occurred due to the friction, etc. However, since the rotary power is also delivered to the arm member 412 through the power delivering member 602 and the guide member 414, loss of the power in the phase shifter of the present embodiment may be reduced than that in the phase shifter in related art. For example, in case that the gear worm 606 is rotated in a forward direction and then is rotated in a reverse direction, loss of the power occurs in the phase shifter in related art, but loss of the power occurs below one rotation in the phase shifter of the present embodiment. In other words, loss of the power in the phase shifter of the present embodiment is less than that in the phase shifter in related art.

In above description, the phase shifter of the present embodiment outputs five signals to the radiation devices. However, the number of the signals may be changed in accordance with characteristic of an antenna device. In this case, number and disposition of lines will be also changed depending on the signals.

Additionally, the dielectric substrate 400 is formed on whole area of the ground plate in the above description. However, a dielectric layer different from the dielectric substrate 400 may be formed on a part of the ground plate.

In brief, the dielectric substrate and structure and disposition of the lines may be variously changed as long as the rotation member 600 (or rotation axis member 410) is combined with the guide member 414 through the power delivering member 602.

In above description, the guide projection member 414D is extended from the supporting member 414C, and is inserted into the inserting section 604 of the power delivering member 602.

In another example embodiment of the present invention, the guide projection member is not formed at the guide member, but the power delivering member may have a bent shape, e.g. "L" shape. In this case, one end of the power delivering member is connected to the rotation member, and the other end of the power delivering member may be inserted to a recess formed on a lower surface of the supporting member so that the power delivering member is combined with the guide member.

In short, the shape of the power delivering member, connection between the power delivering member and the rotation member (or rotation axis member) and the connection between the power delivering member and the guide member may be variously changed as long as the rotation member (or rotation axis member) is connected to the guide member through the power delivering member.

Figure 9:
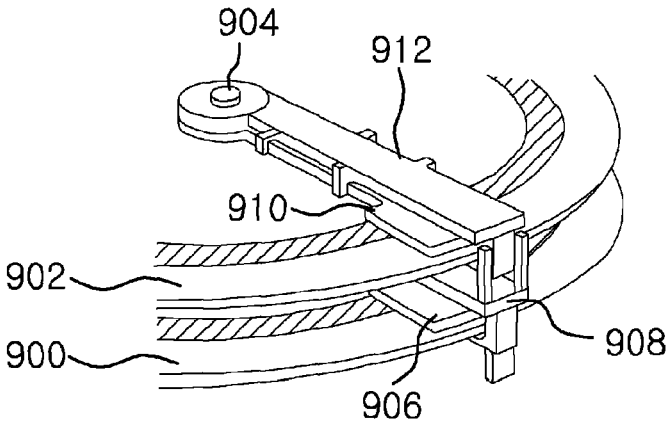
FIG. 9 is a perspective view illustrating a phase shifter according to a second example embodiment of the present invention.
Figure 10:
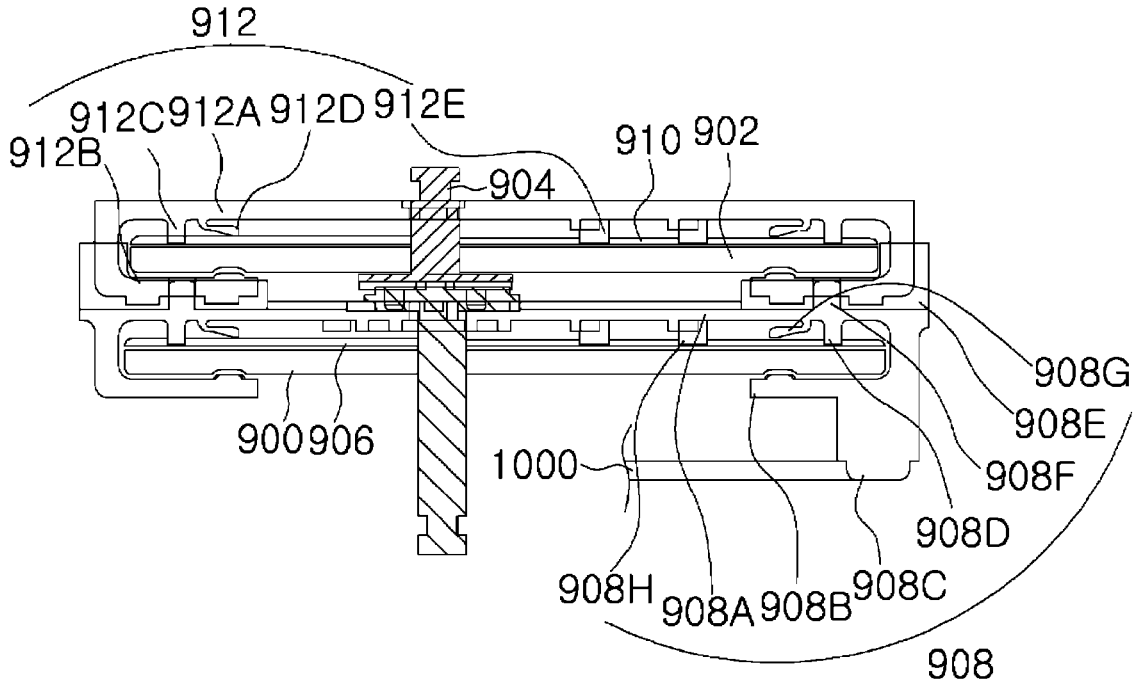
FIG. 10 is a sectional view illustrating the phase shifter in FIG. 9 according to an exemplary embodiment of the present invention.

FIG. 9 is a perspective view illustrating a phase shifter according to a second example embodiment of the present invention. FIG. 10 is a sectional view illustrating the phase shifter in FIG. 9 according to an exemplary embodiment of the present invention.

In FIG. 9, the phase shifter of the present embodiment includes a first dielectric substrate 900, a second dielectric substrate 902, a rotation axis member 904, a first arm member 906, a first guide member 908, a second arm member 910 and a second guide member 912. That is, the phase shifter of the present embodiment includes two sub-phase shifters. Here, each of the sub-phase shifters performs the same operation as the phase shifter in the first embodiment.

The first dielectric substrate 900 has first dielectric constant. Here, lines are formed on the first dielectric substrate 900.

The second dielectric substrate 902 has second dielectric constant. Here, lines are formed on the second dielectric substrate 902. It is desirable that the second dielectric constant is substantially identical to the first dielectric constant.

The rotation axis member 904 is formed through the first dielectric substrate 900 and the second dielectric substrate 902 as shown in FIG. 9, and delivers a rotary power in accordance with rotation of a rotation member (not shown) to the guide members 908 and 912.

The rotation axis member 904 is embodied as one body or is embodied with separable sub-rotation axis members as described below.

The first arm member 906 is combined with the rotation axis member 904, and rotates in response to rotation of the rotation axis member 904. Here, a specific line as a conductor is formed on a lower surface of the first arm member 906.

The second arm member 910 is combined with the rotation axis member 904, and rotates in response to the rotation of the rotation axis member 904. Here, a certain line is formed on a lower surface of the second arm member 910.

The first guide member 908 fixes the first arm member 906, and delivers the rotary power provided through the rotation axis member 904 to the first arm member 906. Here, the second guide member 912 is inserted into the first guide member 908 as shown in FIG. 9.

In addition, the second guide member 912 fixes the second arm member 910, and delivers the rotary power provided through the rotation axis member 904 to the second aim member 910.

In short, the phase shifter of the present embodiment combines a first sub-phase shifter having the first dielectric substrate 900, the first arm member 906 and the first guide member 908 with a second sub-phase shifter having the second dielectric substrate 902, the second arm member 910 and the second guide member 912 through the rotation axis member 904. As a result, in case that the rotation axis member 904 is rotated, the first arm member 906 and the second arm member 910 are rotated simultaneously.

Hereinafter, constitution and combination relation of elements of the phase shifter will be described in detail with reference to accompanying drawing FIG. 10. Here, since a driving member, a rotation member, the rotation axis member 904 and a power delivering member 1000 is similar to that in the first embodiment, any further description concerning the similar elements will be omitted.

In FIG. 10, the first guide member 908 includes a first guide base member 908A, a first supporting member 908B, a first guide projection member 908C, a first inserting member 908D, a supporting member receiving member 908E, a second guide projection member 908F, a first tension member 908G and a first side projection member 908H.

The second guide member 912 has a second guide base member 912A, a second supporting member 912B, a second inserting member 912C, a second tension member 912D and a second side projection member 912E.

The first guide base member 908A is disposed on the first arm member 906.

The first supporting member 908B is supported by the first dielectric substrate 900.

The first guide projection member 908C is inserted into an inserting member of the power delivering member 1000 as shown in FIG. 10, and so the rotation member is combined with the first guide member 908.

The first inserting member 908D is inserted into a recess formed on an upper surface of the first arm member 906, thereby fixing the first arm member 906 to the first guide member 908. As a result, the rotary power in accordance with rotation of the rotation axis member 904 is delivered to the first arm member 906.

In FIG. 10, the supporting member receiving member 908E receives the supporting member 912B of the second guide member 912. Here, shape of the supporting member receiving member 908E is not limited as long as the supporting member receiving member 908E receives the supporting member 912B.

Since the supporting member receiving member 908E receives the second guide member 912, the first sub-phase shifter having the first guide member 908 and the second sub-phase shifter having the second guide member 912 operate stably together.

In addition, the rotary power is delivered to the second arm member 910 through the rotation axis member 904 and the second guide member 912, and is provided to the second arm member 910 through the power delivering member, the first guide member 908 and the second guide member 912. As a result, loss of the power delivered to the second arm member 910 from the rotation member may be reduced.

Again referring to FIG. 10, the second guide projection member 908F is inserted into a recess formed in the second guide member 912 in the supporting member receiving member 908E, and so the rotary power in accordance with the rotation of the rotation member is adequately delivered to the second guide member 912.

The first tension member 908G adheres closely to the first arm member 906, and assists the first arm member 906 and the first dielectric substrate 900 so that certain space is existed between the first aim member 906 and the first dielectric substrate 900.

The first side projection member 90811 supports side of the first arm member 906, thereby fixing the first arm member 906 to the first guide member 908.

The second guide base member 912A of the second guide member 912 is located on the second arm member 910.

The second supporting member 912B is supported by the second dielectric substrate 902, and is received in the supporting member receiving member 908E of the first guide member 908.

The second inserting member 912C is inserted into a recess formed on an upper surface of the second arm member 910, thereby fixing the second arm member 910 to the second guide member 912. As a result, the rotary power of the rotation axis member 904 is delivered to the second arm member 910.

The second tension member 912D adheres closely to the second arm member 910, and assists the second arm member 910 and the second dielectric substrate 902 so that certain space is existed between the second arm member 910 and the second dielectric substrate 902.

The second side projection member 912E supports side of the second arm member 910, thereby fixing the second arm member 910 to the second guide member 912.

In brief, the phase shifter of the present embodiment has two sub-phase shifters for sharing the rotation axis member 904, operates stably together the sub-phase shifters by setting properly the guide members 908 and 912, and delivers efficiently the rotary power to the arm members 906 and 910.

In addition, the first guide projection member 908C is combined with the power delivering member 1000, and so the first guide member 908 is connected to the rotation member (or rotation axis member 904). As a result, loss of the rotary power is reduced. Here, FIG. 10 shows only one guide projection member 908C formed on one end of the first guide member 908. However, the phase shifter may further include new guide projection member formed on the other end (left part in FIG. 10) of the first guide member 908 and new power delivering member combined with the new guide projection member. As a result, the rotary power in accordance with the rotation of the rotation member may be more efficiently delivered to the guide members 908 and 912 and the arm members 906 and 910.

In the above description, the phase shifter is made up of two sub-phase shifters. However, the phase shifter may have at least three sub-phase shifters. That is, the phase shifter of the present embodiment has at least two sub-phase shifters. In this case, the rotation axis member 904 may be embodied with one body. However, it is desirable that the rotation axis member 904 is embodied with separable type so that the sub-phase shifters are separated. This separable rotation axis member 904 will be described in detail with reference to accompanying drawings FIG. 11 and FIG. 12.

Figure 11:
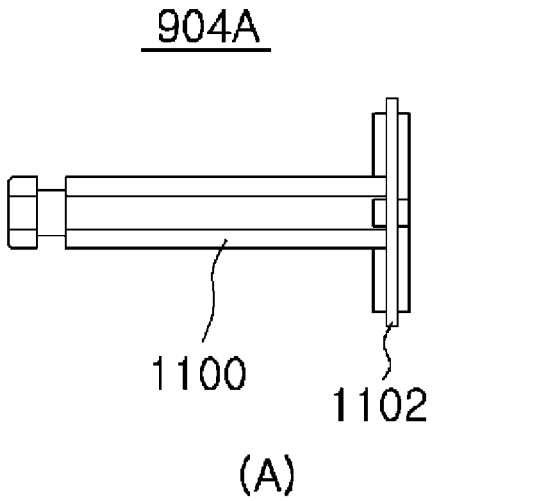
FIGS. 11A-C are views illustrating the first sub-rotation axis member of the rotation axis member according to an exemplary embodiment of the present invention.
Figure 12:
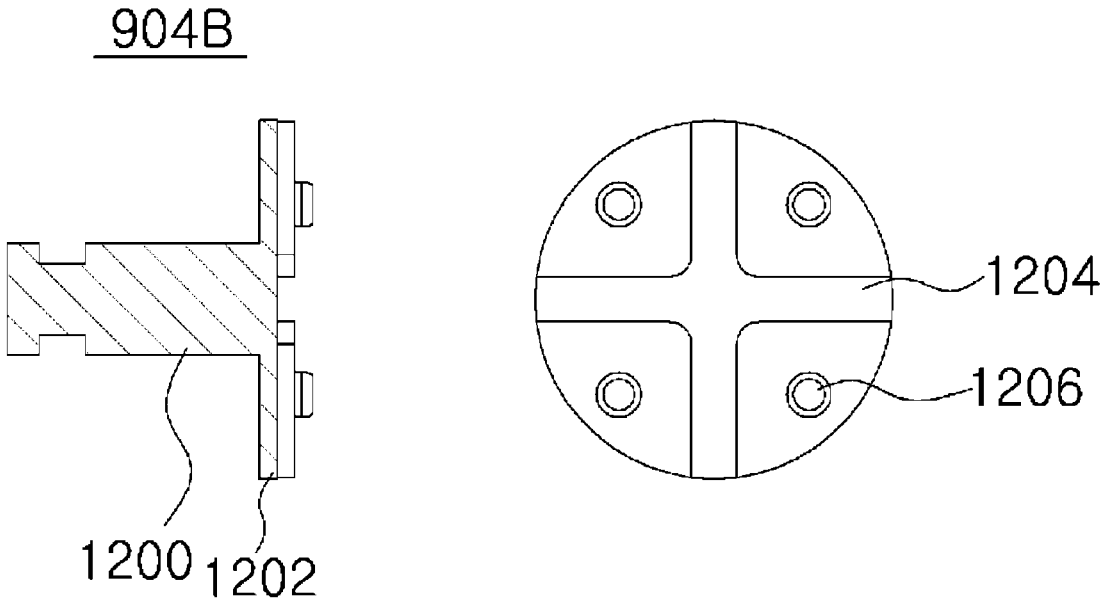
FIGS. 12A-B are views illustrating a second sub-rotation axis member according to an exemplary embodiment of the present invention.

FIG. 11 is a view illustrating a first sub-rotation axis member of the rotation axis member according to an exemplary embodiment of the present invention. FIG. 12 is a view illustrating a second sub-rotation axis member of the rotation axis member according to an exemplary embodiment of the present invention.

As can be seen in FIGS. 11A-C and FIGS. 12A-B, the rotation axis member includes a first-sub rotation axis member 904A (FIGS. 11A-C)) connected to the rotation member and for rotating the first sub-phase shifter through the first dielectric substrate 900 (FIG. 10) and a second sub-rotation axis member 904B (FIGS. 12A-B) for rotating the second sub-phase shifter through the second dielectric substrate 902 (FIG. 10). Here, the first sub-rotation axis member 904A (FIGS. 11A-C) and the second sub-rotation axis member 904B (FIGS. 12A-B) are combined between the first sub-phase shifter and the second sub-phase shifter.

Hereinafter, the sub-rotation axis members 904A and 904B will be described in detail.

Firstly, the first sub-rotation axis member 904A will be described.

In FIG. 11A, the first sub-rotation axis member 904A includes a first rotation axis base member 1100 and a first rotation axis combination member 1102.

The first rotation axis base member 1100 is connected to the rotation member.

The first rotation axis combination member 1102 is formed on an end of the first rotation axis base member 1100, and has circular shape. Here, width of the first rotation axis combination member 1102 is greater than that of the first rotation axis base member 1100 as shown in FIG. 11A.

Additionally, as can be seen in FIG. 11B, a rotation axis projection member 1104 and a rotation axis inserting member 1106 are formed on an upper surface of the first rotation axis combination member 1102.

The rotation axis projection member 1104 (FIG. 11B) is inserted into a rotation axis receiving member 1204 (FIG. 12B) of the second sub-rotation axis member 904B (FIGS. 12A-B) when the second sub-rotation axis member 904B is combined with the first sub-rotation axis member 904A (FIGS. 11A-C), and is embodied with for example cross shape as shown in FIG. 11B.

The rotation axis inserting member 1106 (FIG. 11B) is made up of recess or hole so that a rotation axis projection member 1206 (FIG. 12B) of the second sub-rotation axis 904B (FIGS. 12A-B) is inserted into the rotation axis inserting member 1106 when the second sub-rotation axis member 904B (FIGS. 12A-B) is combined with the first sub-rotation axis member 904A (FIGS. 11A-C). For example, the rotation axis inserting member 1106 (FIG. 11B) is located between cross parts of the rotation axis projection member 1104 (FIG. 11B), and may be made up of a recess having circular shape.

In an exemplary embodiment of the present invention, a rotation axis projection member 1108 may be formed on a lower surface of the first rotation axis combination member 1102 as shown in FIG. 11C. Here, the rotation axis projection member 1108 may be inserted into a cross type recess (not shown) formed on an upper surface of the first guide member 908. As a result, the rotary power in accordance with the rotation of the rotation axis 904 may be more much delivered to the first guide member 908. On the other hand, the structure of the first rotation axis combination member 1102 may be variously changed as long as the first rotation axis combination member 1102 is combined with the second rotation axis combination member 1202.

Next, the second sub-rotation axis member 904B will be described in detail.

In FIG. 12A, the second sub-rotation axis member 904B includes a second rotation axis base member 1200 and the second rotation axis combination member 1202.

The second rotation axis base member 1200 is connected to the second arm member 910 through the second dielectric substrate 902.

The second rotation axis combination member 1202 is combined with the first rotation axis combination member 1102, and has the rotation axis receiving member 1204 and a rotation axis projection member 1206.

The rotation axis receiving member 1204 receives the rotation axis projection member 1104 of the first sub-rotation axis member 904A. Accordingly, since the rotation axis projection member 1104 has cross shape, the rotation axis receiving member 1204 has cross shape.

The rotation axis projection member 1206 has projected structure so that the rotation axis inserting member 1106 of the first sub-rotation axis member 904A is inserted thereinto.

Structure of the second sub-rotation axis member 904B is not limited as long as the second sub-rotation axis member 904B is combined with the first sub-rotation axis member 904A.

In short, the rotation axis member 904 of the present embodiment includes the sub-rotation axis members 904A and 904B combined each other. Hence, in case of using the sub-phase shifters, the sub-rotation axis members 904A and 904B are combined. However, in case of using only one sub-phase shifter, the second sub-rotation axis member 904B is separated from the first sub-rotation axis member 904A. Accordingly, the phase shifter may be embodied with various shapes, and convenience of a user may be enhanced.

In above description, the phase shifter of the present embodiment is made up of two sub-phase shifters. However, the phase shifter may be made up of at least three sub-phase shifters. In this case, the rotation axis may be made up of three or more sub-rotation axis members so that the sub-phase shifters are combined.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The invention claimed is:

1. A phase shifter comprising:

a rotation member;

a first rotation axis member combined with the rotation member in a direction crossing over the rotation member;

a first guide member combined with the first rotation axis member, and configured to rotate in accordance with rotation of the first rotation axis member; and a first rotary power delivering member configured to connect at least one of the rotation member and the first rotation axis member to the first guide member.

2. The phase shifter of claim 1, further comprising:

a second rotary power delivering member configured to combine at least one of the rotation member and the first rotation axis member with the first guide member, wherein the first rotary power delivering member is combined with one end of the first guide member, and the second rotary power delivering member is combined with other end of the first guide member.

3. The phase shifter of claim 1, further comprising:

a first arm member longitudinal-extended outward from the first rotation axis member, and connected to the first guide member; and a first line disposed on the first arm member.

4. The phase shifter of claim 3, further comprising:

a first dielectric substrate located between the rotation member and the first arm member, wherein the first rotation axis member penetrates the first dielectric substrate, and a second line as a conductor is disposed on the first dielectric substrate, and wherein the first guide member includes:

a first guide base member disposed in a longitudinal direction of the first arm member;

a first supporting member supported by the first dielectric substrate; and a first guide projection member projected in a direction of the first rotary power delivering member from the first supporting member, and configured to combine with the first rotary power delivering member.

5. The phase shifter of claim 3, further comprising:

a second rotation axis member combined with the first rotation axis member;

a second arm member connected to the second rotation axis member, and longitudinal-extended outward from the second rotation axis member; and a second guide member connected to the second rotation axis member and the second arm member, and configured to rotate the second aim member in accordance with the rotation of the second rotation axis member, wherein a third line as a conductor is disposed on one side of the second arm member.

6. The phase shifter of claim 5, wherein the first rotation axis member includes:

a first rotation axis base member; and a first rotation axis combination member formed at one end of the first rotation axis base member, and configured to have circular shape, wherein a first rotation axis projection member and at least one rotation axis inserting member is formed on one side of the first rotation axis combination member, and wherein the second rotation axis member includes:

a second rotation axis base member; and a second rotation axis combination member faced to the first rotation axis combination member at an end of the second rotation axis base member, and configured to have circular shape, wherein a first rotation axis receiving member for receiving the first rotation axis projection member and at least one second rotation axis projection member inserted into the at least one rotation axis inserting member are formed on one side of the second rotation axis combination member.

7. The phase shifter of claim 6, wherein the at least one rotation axis inserting member is a hole.

8. The phase shifter of claim 6, wherein a third rotation axis protection member is formed on the other side of the first rotation axis combination member, and a first guide receiving member for receiving the third rotation axis projection member is formed on an upper surface of the first guide member.

9. The phase shifter of claim 6, further comprising:

a second dielectric substrate located between the first guide member and the second arm member, wherein the second rotation axis member penetrates the second dielectric substrate, and a fourth line as a conductor is disposed on the second dielectric substrate, and wherein the second guide member includes:

a second guide base member formed in a longitudinal direction of the second arm member; and a second supporting member supported by the second dielectric substrate.

10. The phase shifter of claim 9, wherein the first guide member further includes a supporting member receiving member formed in a direction of the second guide member from the first guide member at an end of the first guide member so that the second supporting member of the second guide member is received.

11. The phase shifter of claim 9, wherein a second guide projection member is formed at one side of the first guide member, and a second guide receiving member for receiving the second guide projection member is formed on the second supporting member of the second guide member.

12. The phase shifter of claim 1, wherein a recess or hole is formed on the first rotary power delivering member, and wherein the first guide member is inserted into the recess or hole.

13. The phase shifter of claim 1, wherein an inserting section is formed on the first guide member, and the first rotary power delivering member has bent shape, and wherein one end of the first rotary power delivering member is combined with one or more of the rotation member and the first rotation axis member, and the other end of the first rotary power delivering member is inserted into the inserting section of the first guide member.

14. A phase shifter comprising:

a rotation member;

a rotation axis inserting member disposed in a vertical direction of the rotation member;

a rotation axis member combined with the rotation member under the condition that the rotation axis member is inserted into the rotation axis inserting member;

an arm member connected to the rotation axis member, and longitudinal-extended in an outside direction of the rotation axis member from the rotation axis member;

a guide member combined with the rotation axis member and the arm member, and configured to rotate the arm member in accordance with rotation of the rotation axis member; and a rotary power delivering member configured to connect the rotation axis inserting member to the guide member.

15. The phase shifter of claim 14, wherein the rotary power delivering member has bent shape, and an inserting member is formed on the guide member, and wherein the rotary power delivering member is inserted into the inserting member.

16. The phase shifter of claim 14, wherein an inserting section is formed on a part of the rotary power delivering member, and wherein a part of the guide member is inserted into the inserting section.

* * * * *